US006003705A

United States Patent [19]

Burguieres, Jr.

[11] Patent Number: 6,003,705

[45] Date of Patent: Dec. 21, 1999

[54] PORTABLE BULK STORAGE CONTAINER HAVING AND EASY OPENING LID

[75] Inventor: Chapman H. Burguieres, Jr., Houma, La.

[73] Assignee: Magnum Mud Equipment Company, Houma, La.

[21] Appl. No.: 09/081,705

[22] Filed: May 19, 1998

[51] Int. Cl.[6] ..... B65D 88/06; B65D 90/66

[52] U.S. Cl. ..... 220/1.5; 49/386; 220/668; 220/828

[58] Field of Search ..... 220/1.5, 668, 810, 220/820, 821, 823, 827, 828; 49/386; 222/180, 405; 292/256.5

[56] References Cited

U.S. PATENT DOCUMENTS

| | | | |
|---|---|---|---|
| 245,437 | 8/1881 | Bollman | 220/828 X |
| 1,115,346 | 10/1914 | Stiles . | |
| 2,372,753 | 4/1945 | Watson | 68/242 |
| 2,424,715 | 7/1947 | Shreve | 312/189 |
| 2,587,714 | 3/1952 | Embree et al. | 222/405 X |
| 2,603,381 | 7/1952 | Bilek | 220/828 X |
| 2,681,165 | 6/1954 | Kornhauser et al. | 220/828 |
| 3,838,537 | 10/1974 | Stavenau et al. | 49/248 |
| 4,227,414 | 10/1980 | Elkins | 73/425.4 |
| 4,467,932 | 8/1984 | Dabich | 220/18 |
| 4,655,357 | 4/1987 | Hampton, Jr. | 220/1.5 |
| 4,669,625 | 6/1987 | Armstrong | 220/18 |
| 4,744,183 | 5/1988 | Kruger | 52/192 |
| 5,673,810 | 10/1997 | Rothrock | 220/264 |

FOREIGN PATENT DOCUMENTS

| | | | |
|---|---|---|---|
| 4320054 | 4/1994 | Germany | 206/509 |
| 2168415 | 6/1986 | United Kingdom | 220/1.5 |
| 2189773 | 11/1987 | United Kingdom | 220/1.5 |

*Primary Examiner*—Allan N. Shoap
*Assistant Examiner*—Joe Merek
*Attorney, Agent, or Firm*—Roy, Kiesel & Tucker

[57] ABSTRACT

A portable bulk storage container having a counterweight mechanism for opening and closing a heavy lid. The container comprises a substantially gas and liquid tight tank secured inside of a frame. An opening is positioned on a front portion of a top of the tank. A lid is pivotally connected to the top of the tank for sealing the opening. A pair of fulcrums or connecting members extend from opposite sides of a rear portion of the lid. A counterweight is attached to each fulcrum. Each counterweight has an elongated lever end which extends away from the rear of the lid such that the counterweight can be used to rotate the lid between closed and open positions. Each counterweight is positioned beyond a side wall of the tank such that the counterweights can be rotated along the side wall of the tank, thereby effectively utilizing the limited amount of space available inside of the frame. The counterweights are of a sufficient length and weight in relation to the weight of the lid such that when the lid is placed in a closed or open position, the lid remains in that position under the normal force of gravity. The counterweights are further of a sufficient length and weight in relation to the weight of the lid such that the application of an additional force having a downward component to the lever end of the counterweight causes the lid to rotate between closed and open positions. The force for opening and closing said lid can preferably be provided by a person of ordinary weight.

26 Claims, 6 Drawing Sheets

PORTABLE BULK STORAGE CONTAINER HAVING AND EASY OPENING LID

FIELD OF THE INVENTION

The present invention relates to containers for storing and shipping materials, and more particularly to portable bulk storage and shipping containers having a heavy but easy opening lid.

BACKGROUND OF THE INVENTION

In the petroleum, chemical, and other bulk manufacturing industries, hazardous liquid and solid materials are often stored and shipped in large containers, such as Intermediate Bulk Containers (IBCs), IM 101s, and IM 102s (hereinafter referred to collectively as "bulk containers"). Because many of these materials are noxious or hazardous products, bulk containers must be constructed in accordance with certain regulations, many of which are established by international agreement. In the United States, the applicable regulations for the design and construction of bulk containers are promulgated by the U.S. Department of Transportation, and are embodied in Volume 49, Part 178 of the Code of Federal Regulations, which is incorporated herein by reference (see particularly 49 C.F.R. §§ 178.270–178.272-2 and 178.700).

Under the regulations, IBCs are defined as having a volume of not more than 3 cubic meters (793 gallons) and not less than 0.45 cubic meters (119 gallons) or a maximum net mass of not less than 400 kilograms (882 pounds). 37 C.F.R. § 178.700(c)(1). IMs are defined as portable tanks having a diameter no greater than 2438 mm (96 inches) that are designed to carry liquids having a vapor pressure of less than 2.97 bar-absolute (43 psia) at a temperature of 50° C. 37 C.F.R. § 178.270-1(a). IMs must be cylindrical in shape, while IBCs are not required to be cylindrical. The construction and design of IMs is generally more strictly regulated than that of IBCs.

Bulk containers such as IBCs and IMs consist of a tank enclosed in a frame. The frame is designed such that the bulk containers can be stacked one-on-top-another. The frame is equipped with features which facilitate moving and accessing the tank. Such features include slots for lifting the container with a forklift, pad eyes for lifting the container with a crane, and ladders for accessing the top of the tank. The frame also provides some degree of protection to the tank.

To comply with applicable regulations, a bulk container, and particularly IBC containers, must pass certain tests, including vibration, hydrostatic, stacking, and drop tests. In order to pass these tests, a bulk container must be of substantial construction. One significant problem that arises with bulk containers of substantial construction is that is they have very heavy lids. The heavy lids of prior art bulk containers are difficult to open and can cause serious injury. The heavy lids of prior art bulk containers must either be opened by two people working together, or by one person working with the assistance of a crane. Because the people opening the lid are required to place their hands and arms near the lid and the opening, the lid can fall on the people opening the lid, resulting in crushed or even severed body parts. The prior art lids tend to close rapidly when dropped, which may not provide sufficient time to withdraw an arm, hand, or other body part from the tank opening before the lid closes. Additionally, the stress of opening a heavy lid can lead to injuries, such as muscle pulls or ruptured discs. The use of a crane to open bulk containers adds to the expense of using such containers, and can also cause injury.

Various types of counterweights have been used to assist in opening and closing heavy lids on containers. Many of the prior art counterweights mechanisms are directed to subterranean containers, such as the type which are placed below the surface of airport docking areas. One disadvantage of the prior art mechanisms for subterranean containers is that they occupy some of the internal volume of the tank, thereby decreasing the volume available for use. See U.S. Pat. No. 5,673,810 (Rothrock); U.S. Pat. No. 4,669,625 (Armstrong); U.S. Pat. No. 4,467,932 (Dabich). Other counterweight mechanisms rely upon relatively large and obtrusive external structures which would not work within the space limitations imposed by the frame of a bulk container. See U.S. Pat. No. 4,227,414 (Elkins); U.S. Pat. No. 2,424,715 (Shreve); U.S. Pat. No. 2,372,753 (Watson).

A major disadvantage of the prior art counterweights is that they are not designed to efficiently use the limited amount of space available in bulk containers. Because bulk containers are designed for storage and shipping, they must provide as much storage tank volume as possible within the space limitations imposed by the frame of the container. There is thus a need for a counterweight mechanism for opening and closing the heavy lid of a bulk container which efficiently uses the space available within the frame.

OBJECTS AND SUMMARY OF THE INVENTION

It is an object of the invention to provide a heavy but easy opening lid for a portable bulk storage container.

It is another object of the invention to provide a counterweight which allows a heavy lid of a bulk container to be easily opened and closed by a person of ordinary weight.

It is another object of the invention to provide a counterweight which is external to the storage tank, so that the counterweight does not to decrease the internal volume of the storage tank.

It is another object of the invention to provide a counterweight which operates within the confines imposed by the frame of a bulk container.

It is another object of the invention to provide a counterweight which can be used as a handle to provide leverage while opening the lid.

These and other objects and advantages of the invention shall become apparent from the following general and preferred description of the invention.

Accordingly, a portable bulk storage container having a heavy but easy opening lid is provided. The container comprises a substantially gas and liquid tight tank secured inside of a frame. An opening is positioned on a front portion of a top of the tank. A lid is pivotally connected to the top of the tank for sealing the opening. A fulcrum or connnecting member extends from a side of a rear portion of the lid. A counterweight is attached to the fulcrum. The counterweight has an elongated lever end which extends away from the rear of the lid such that the counterweight can be used to rotate the lid between closed and open positions. In a preferred embodiment, a fulcrum extends from both sides of a rear portion of the lid, and a counterweight is attached to each fulcrum. Each counterweight is positioned beyond a side wall of the tank such that the counterweights can be rotated along the side wall of the tank, thereby effectively utilizing the limited amount of space available inside of the frame. The counterweights are of a sufficient length and weight in relation to the weight of the lid such that when the lid is placed in a closed or open position, the lid remains in that position under the normal force of gravity. The counterweights are further of a sufficient length and weight in relation to the weight of the lid such that the application of an additional force having a downward component to the lever end of the counterweight causes the lid to rotate between closed and open positions.

The force for opening and closing said lid can preferably be provided by a person of ordinary weight. The force for opening and closing the lid can also preferably be provided by applying force directly to said lid. The frame is configured to allow a person standing outside of the frame to access the counterweight and to rotate the counterweight to rotate the lid between the open and closed positions. The container is preferably provided with means for securing the lid in the open and closed positions.

PREFERRED EMBODIMENTS OF THE INVENTION

Figure 1:
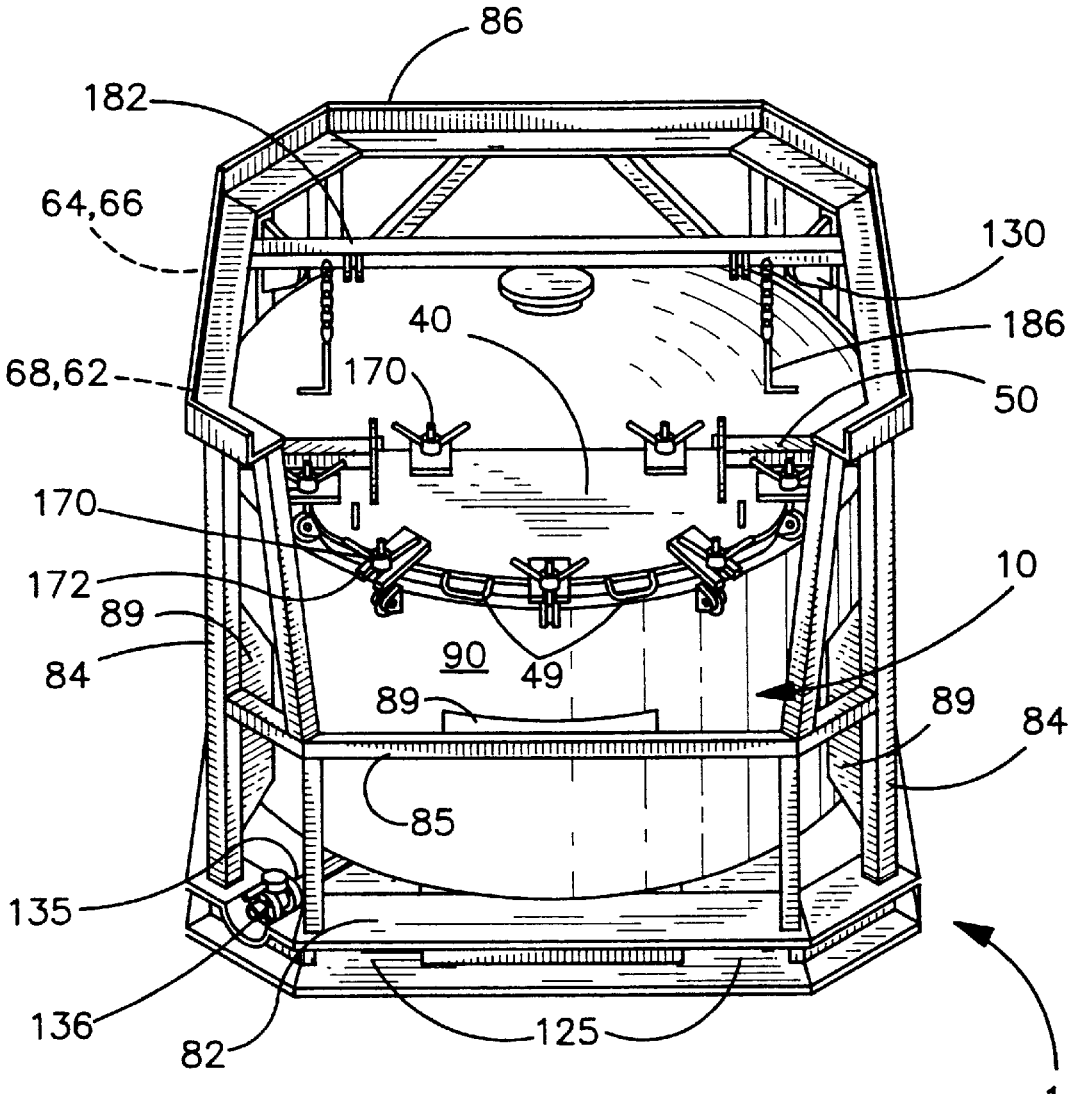
FIG. 1 is a frontal perspective view of one embodiment of the invention illustrating the invention in a closed position.
Figure 5:
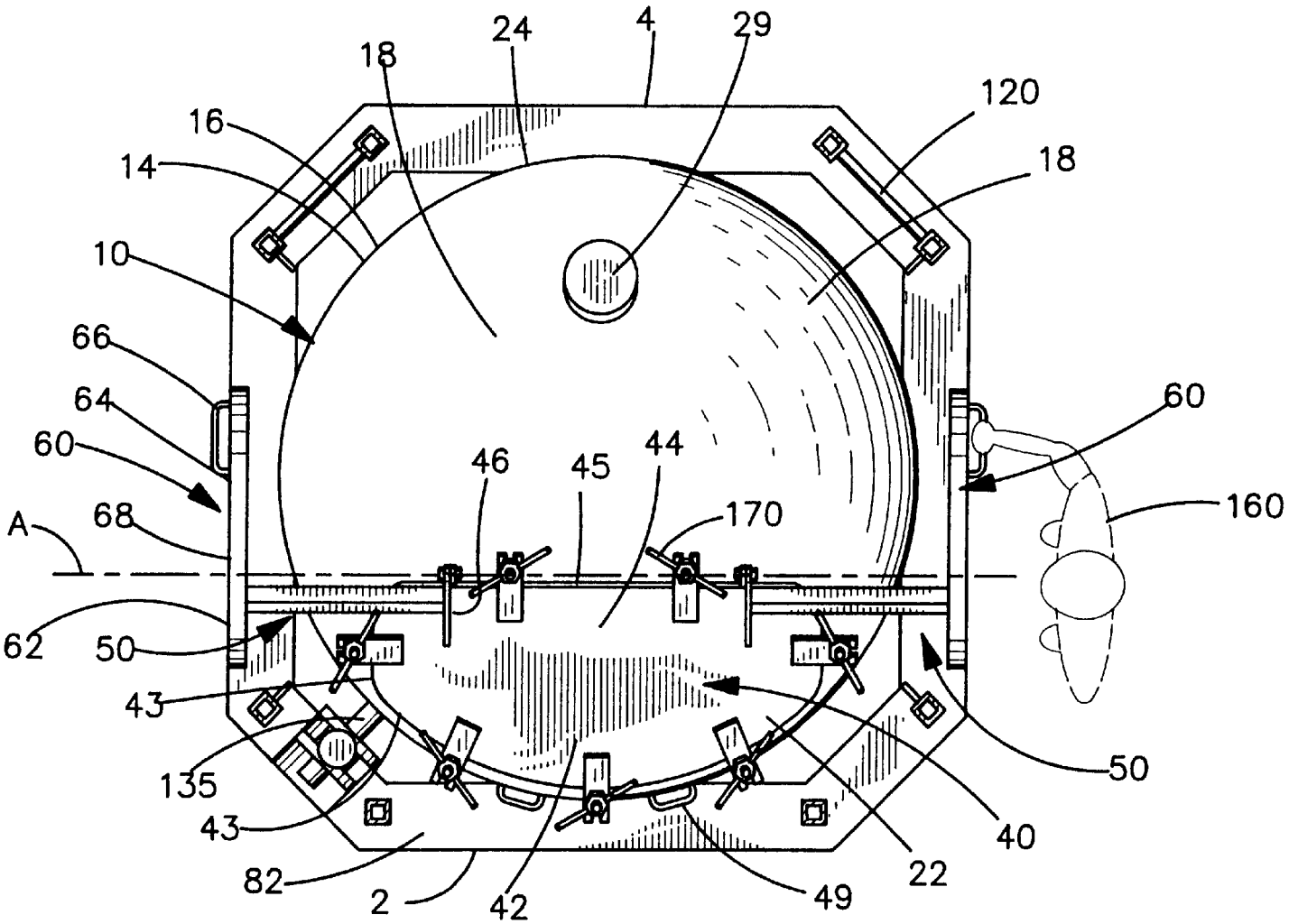
FIG. 5 is a partial cross-sectional top view of one embodiment of the invention illustrating the invention in a closed position.

As shown in FIG. 1, the portable bulk storage container 1 of the invention comprises, generally, (a) a tank 10 having an opening 30; (b) a lid 40 fitted to the opening 30; (c) at least one counterweight 60 attached to the lid 40 by a fulcrum 50 or connecting member 50; and (d) a frame 80 positioned around the tank 10. The counterweight 60 is used to counterbalance the weight of the lid 40, and to thereby make opening and closing the lid 40 easy and safe. As shown in FIG. 5, the lid 40 is positioned toward a front side 2 of the container 1, while the counterweights 60 are positioned toward a rear side 4 of the container 1.

The container of the invention 1 is constructed of materials and by methods specified in applicable regulations. See e.g. 49 C.F.R. §§ 178.702; 178.270-3 thru 270-5. The tank 10, frame 80, counterweights 60, fulcrum 50, and other accessories of the container 1 are typically constructed of steel components welded together by fusion welding. For example, the tank 10 can be constructed of 5/16 inch thick steel.

As shown in FIG. 1, the frame 80 comprises a base 82, a plurality of support members 84 extending upward from the base 82, and a top rail 86 positioned on top of the support members 84. The frame 80 can be provided with horizontal support members 85 to provide additional support to the frame 80. The frame 80 can be provided with support means, such as support plates 89, for supporting the tank 10 within the frame 80 and elevating the tank 10 above the base 82. The top rail 86 is sized and configured to support a second portable bulk container, including a portable bulk container according to the invention 1, when stacked on top of the container 1. In order to comply with applicable regulations, the frame 80 should generally be strong enough to support another fully loaded bulk container stacked on top of the container 1.

Figure 2:
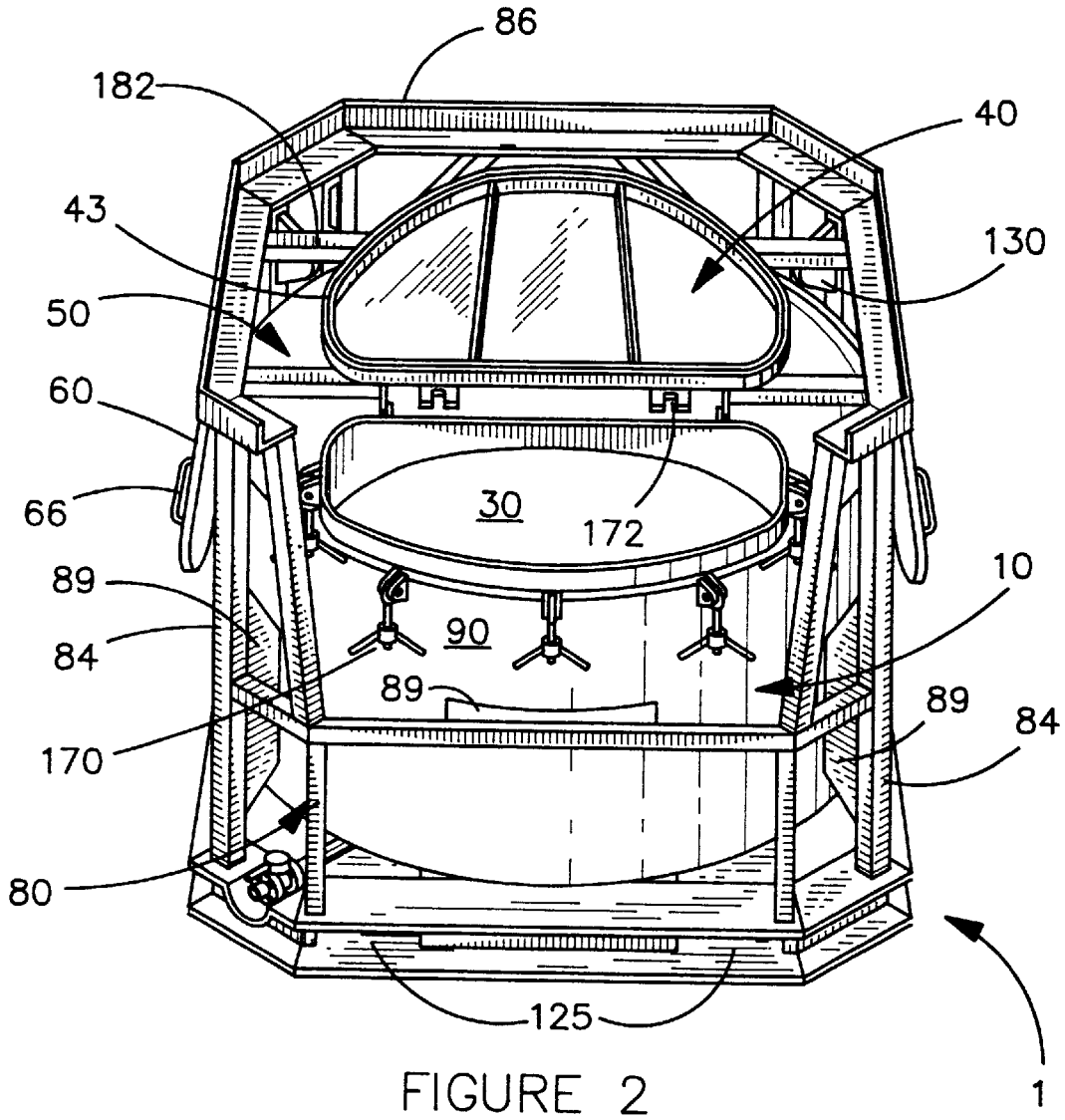
FIG. 2 is a frontal perspective view of one embodiment of the invention illustrating the invention in an open position.
Figure 3:
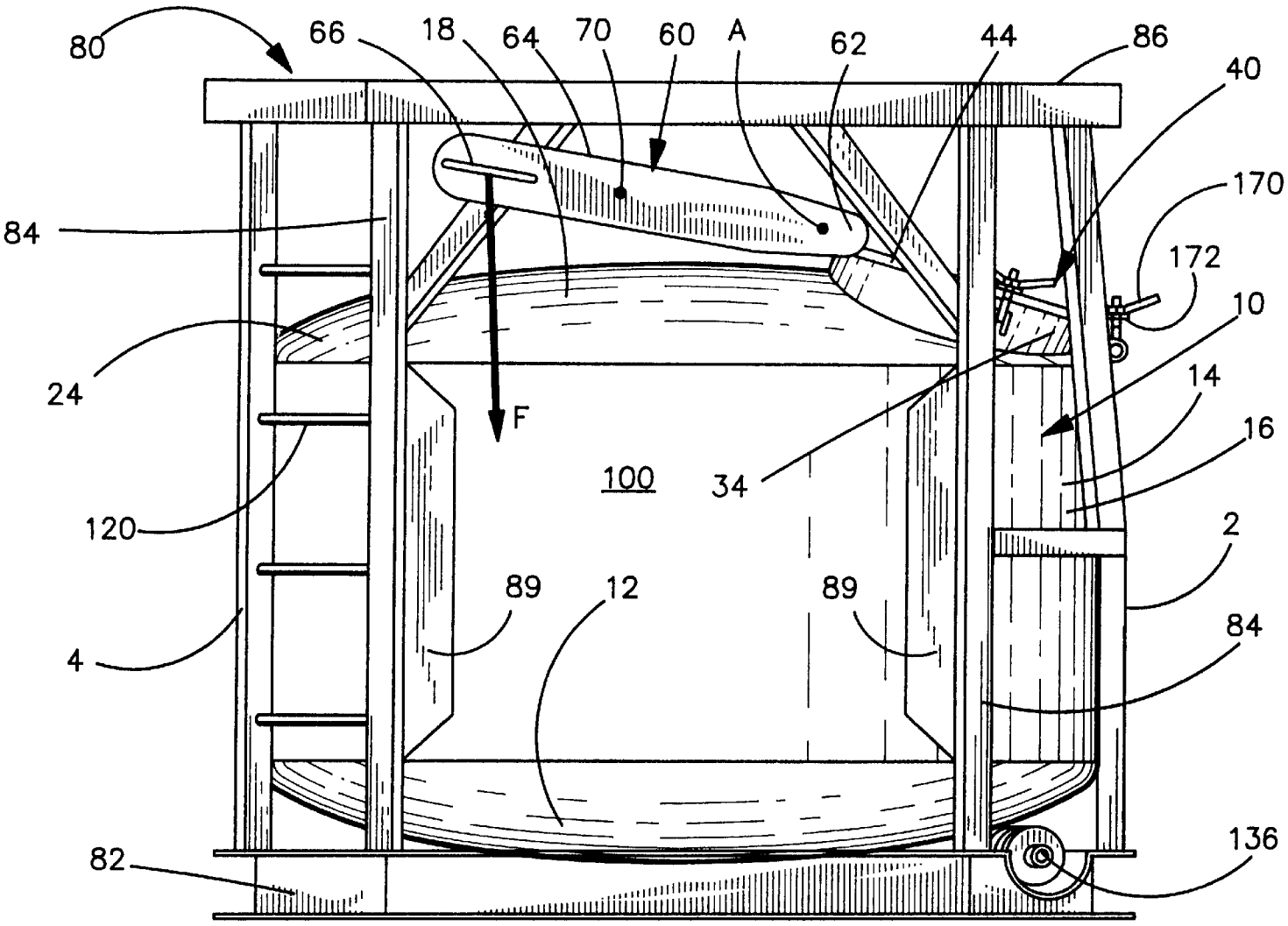
FIG. 3 is a side view of one embodiment of the invention illustrating the invention in a closed position.
Figure 4:
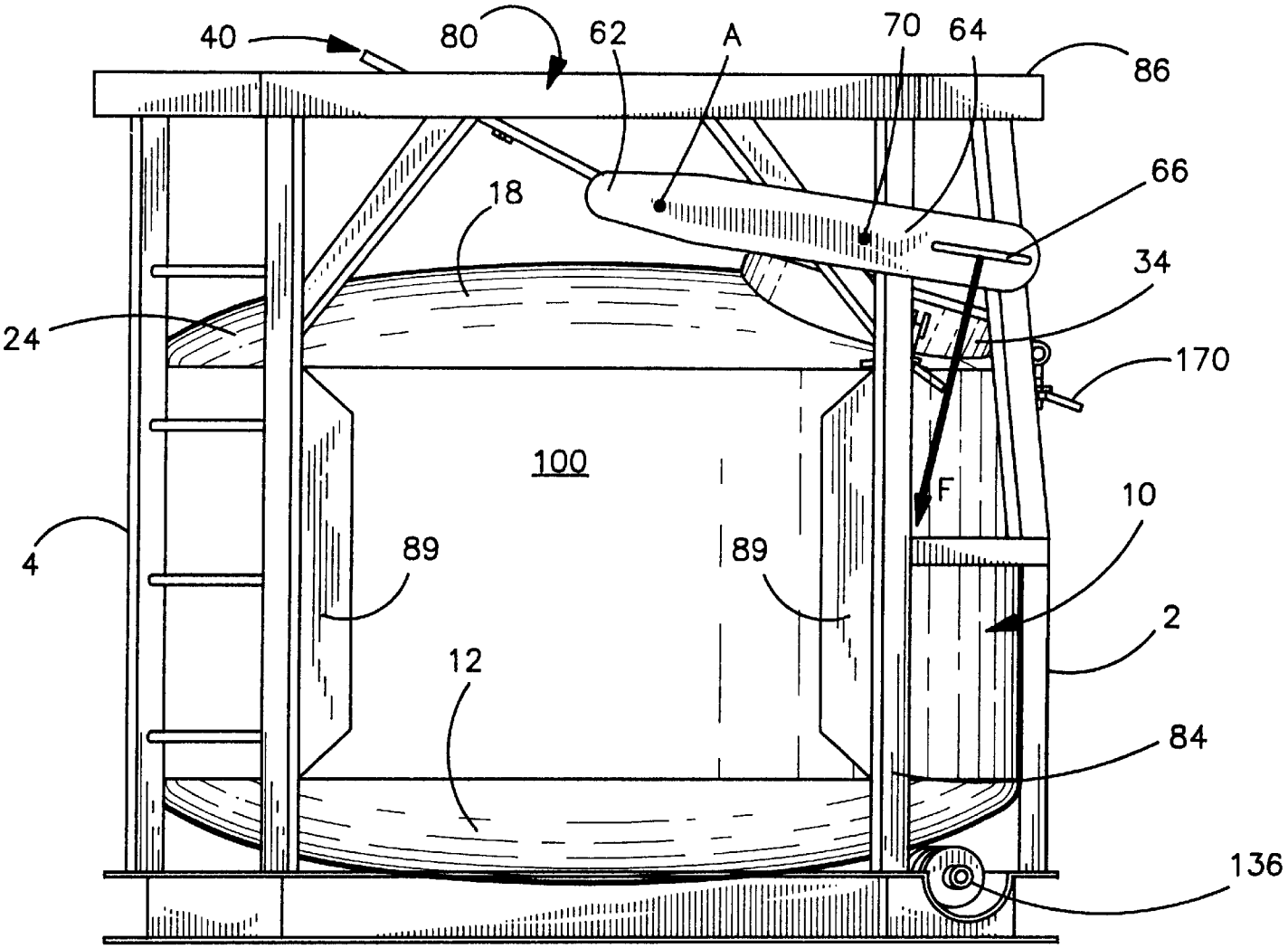
FIG. 4 is a side view of one embodiment of the invention illustrating the invention in an open position.

The frame 80 is configured to allow a person 160 standing outside of the frame 80 to access and rotate the counterweight 60 to rotate the lid 40 between a closed position (FIGS. 1 and 3) and an open position (FIGS. 2 and 4), such as by the open space 100 shown in FIGS. 3 and 4. The front 2 of the frame 80 is further configured to allow a person to access the opening 30, such as by the open space 90 shown in FIGS. 1 and 2.

The tank 10 is positioned inside of the frame 80. The tank 10 has a bottom 12, a top 18, and at least one sidewall 14. In a preferred embodiment, the tank 10 has a cylindrical cross section in the horizontal dimnension, and thus a single cylindrical side wall 16. The cross section of the tank 10 can be configured in non-cylindrical shapes, such as a square or octagon, in which case the tank 10 can be considered to have multiple side walls 14. The side wall 14 or cylindrical side wall 16 is preferably substantially vertical, in order to provide a maximum internal tank volume within the confines imposed by the size of the frame 80.

The tank 10 is preferably gas and liquid tight, such that gases or fluids in the interior of the tank 10 cannot escape through the walls of the tank 10. An opening 30 is positioned substantially on the front portion 22 of the top 18 of the tank 10 to provide access to the interior of the tank 10. The opening 30 is of sufficient size to allow liquid or solid materials to be placed in the tank 10 through the opening 30. The opening 30 is also of sufficient size to comply with applicable regulations. See e.g. 37 C.F.R. 178.270-9. In a preferred embodiment, the opening 30 is approximately less than about half the size of the top 18 of the tank 10, and occupies substantially the entire front portion 22 of the top 18 of the tank 10, as shown in FIGS. 3, 4, and 5.

The top 18 of the tank 10 will typically be configured as a shallow dome. The top 18 of the tank 10 is preferably provided with a lip 34 positioned around the opening 30. The lip 34 can be configured to have a flat top edge, so that the lid 40 for the opening 30 can be substantially flat rather than dome shaped. Additionally, the rear portion of the lip 34 provides a clearance space for the lid 40 and attachments thereto when the lid is opened and closed.

The bottom 12 of the tank 10 is preferably rigidly secured to the base 82 of the frame 80. The side walls 14 of the tank 10 are also preferably secured to at least some of the vertical 84 or horizontal 85 support members.

The bottom 12 of the tank 10 is preferably an inverted shallow dome, because this configuration is easy to drain and clean. A conventional drain pipe 135 can be connected adjacent the lowest part of the bottom 12 of the tank 18 to allow the tank 10 to be drained as needed. The discharge end of the drain pipe 135 is capped with a sealing valve 136, such as a conventional butterfly valve having a disk cap.

The tank 10 is fitted with a pressure relief valve 29. The pressure relief valve 29 is preferably positioned on the rear portion 22 of the top 18 of the tank 10, such that the opening of the lid 40 will not interfere with the pressure relief valve 29.

The tank can be constructed in a wide range of volumes, depending on the applicable regulations and on how and where the tank will be used.

Figure 6A:
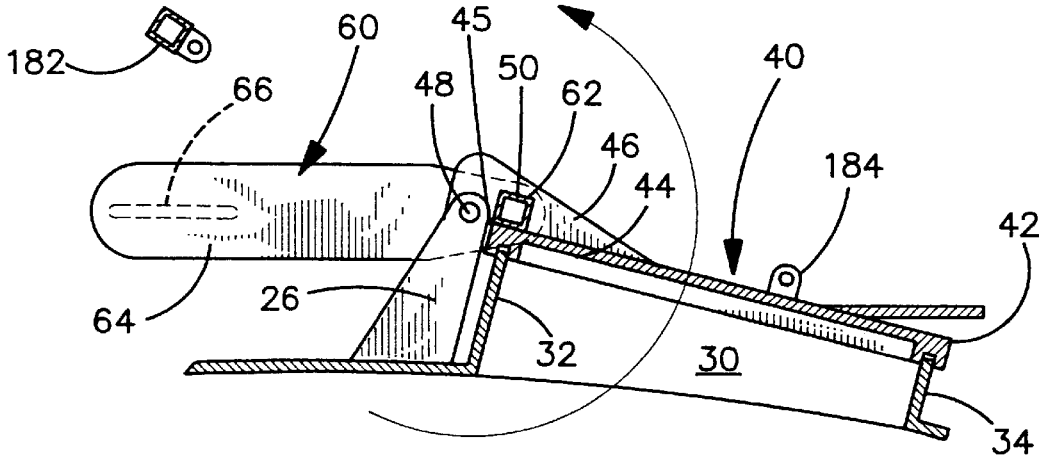
FIG. 6A is a cross-sectional side view of one embodiment of the invention illustrating details of the lid in a closed position.
Figure 6B:
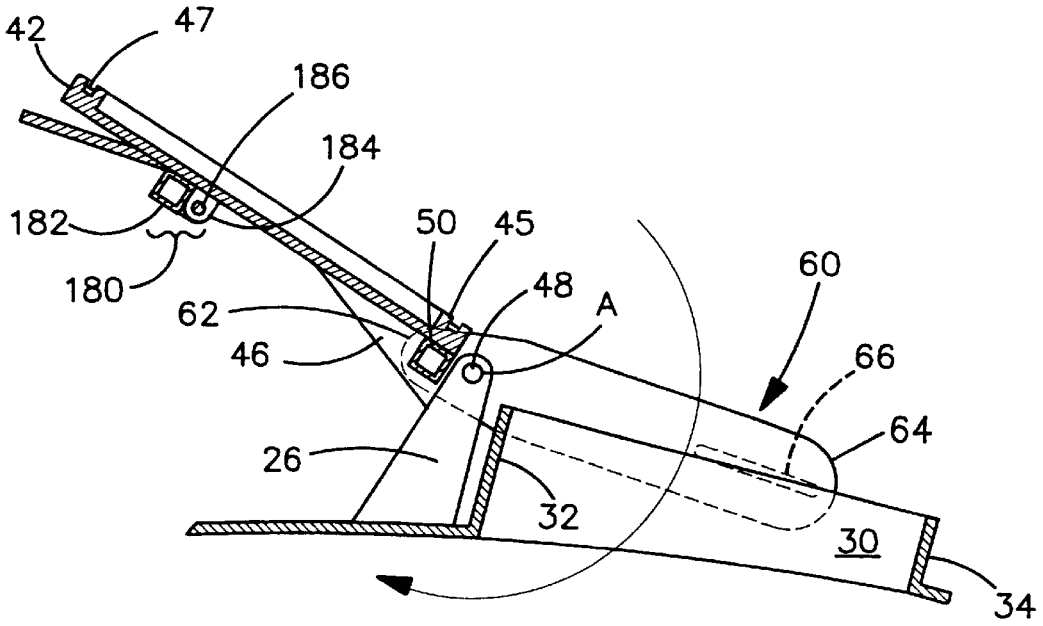
FIG. 6B is a cross-sectional side view of one embodiment of the invention illustrating details of the lid in an open position.

The tank 10 is provided with a lid 40 which is configured to seal the opening 30, such that the opening 30 is substantially gas and liquid tight, as shown in FIG. 6A. As shown in FIG. 5, the lid 40 has a front portion 42 and a rear portion 44. The front portion 42 is oriented toward the front side 2 of the container 1, while the rear portion 44 is oriented toward the rear side 4 of the container 1. The rear portion 44 of the lid 40 has a rear edge 45. The lid also has sides 43. As shown in FIG. 6B, a seal means 47 can be provided on the underside of the lid 40 for sealing the opening 30. The seal means can be a rubber gasket fitted to the size of the opening 30.

The lid 40 is pivotally connected 48 to the top 18 of the tank 10 adjacent a rear edge 32 of the opening 30, such that the lid 40 is positioned to close and seal the opening 30 when the lid 40 is pivoted to a closed position. The pivotal connection can comprise any of a variety of heavy-duty hinge mechanisms for providing a substantially horizontal hinge axis. As shown in FIGS. 6A and 6B, the pivotal connection is preferably a pair of hinges 46 positioned adjacent to or on a rear portion 44 of the lid 40, a matching pair of hinges 26 positioned on tank top 18 adjacent to or on the rear edge 32 of the opening 30, and a hinge bolt 48 passing through each pair of hinges 46 and 26. If a lip 34 is provided about the opening 30, the tank top hinge 26 must be configured to have a sufficient height relative to the upper edge of the lip 34, as shown in FIGS. 6A and 6B. As shown in FIGS. 3, 4, 5, and 6B the linear orientation of the pivotal connection 48 defines a pivot axis A about which the lid 40 and counterweights 60 rotate to open and close the lid 40.

The tank 10 is preferably provided with a locking means 170 for securing the lid in the closed position. As shown in FIGS. 1 and 2, the locking means 170 can be one or more large wingnuts 170 positioned on a front side 2 of the tank 10. As shown in FIG. 5, additional wingnuts 170 can be positioned on the top 18 of the tank 10 along the pivotal connection 48 for locking the rear portion 44 of the lid 40. The front 42 and rear 44 portions of the lid 40 are provided with slots 172 for receiving the wingnuts 170 and locking the lid 40 in a closed position. With the lid 40 properly locked in the closed position by the locking means 170, the opening 30 of the tank 10 is substantially gas and liquid tight.

One or more handles 49 can be provided on the front portion 42 of the lid 40. If adequate counter weighting is provided, a person of ordinary weight 160 standing at the front 2 of the container 1 can use the handles 49 to open and close the lid 40, as will be described further below.

Each counterweight 60 is connected to the lid 40 through a fulcrum 50. Each fulcrum 50 extends from a side 43 of a rear portion 44 of the lid 40. Where two counterweights 60 are provided, a fulcrum 50 extends from either side 43 of a rear portion 44 of the lid 40, as shown in FIG. 5. Each fulcrum 50 extends beyond the side wall 14 of the tank 10. In a preferred embodiment, each fulcrum 50 extends substantially parallel to the pivot axis A, so that the force of the lever arm of the counterweight 60 is directed efficiently through the pivotal connection 48. Each fulcrum is preferably positioned as close to the rear edge 45 of the lid 40 as possible, as shown in FIGS. 5, 6A, and 6B, since this position generally will allow for the use of shorter and lighter 60 counterweights.

The fulcrum 50 can be a bar constructed of steel or other suitably strong metal. Each fulcrum 50 can be a separate bar, as shown in FIG. 5. Alternatively, the fulcrums 50 can be a single bar which extends beyond both sides 43 of the lid 40.

The bulk container of the invention 1 is provided with at least one counterweight 60 attached to the lid 40 by a fulcrum 50. The invention 1 is preferably provided with two counterweights 60 positioned on opposite sides 43 of the lid, as shown in FIGS. 2–5. The arrangement of two counterweights 60 positioned on opposite sides 43 of the lid 40 allows the weight of the counterweights 60 to be distributed evenly along the pivot axis A, particularly if the counterweights 60 are of substantially the same length and weight. If only one counterweight 60 is used, the counterweight 60 typically will have to weigh as much as or more than the combined weight of a suitable pair of counterweights 60.

Each counterweight 60 has a fulcrum end 62 and an elongated lever end 64. A handle 66 is preferably placed on an outer side 68 of the counterweight 60 to assist an operator 160 in applying an opening or closing force to the counterweight.

The counterweight 60 is rigidly attached to the fulcrum 50 adjacent the fulcrum end 62 of the counterweight 60, such that when the counterweight 60 is rotated about pivot axis A, the lid 40 rotates between the open and closed positions. The fulcrum 50 is preferably attached as close to the fulcrum end 62 as possible. The counterweight 60 must be positioned beyond the side wall 14 of the tank 10 such that the counterweight 60 can be rotated along the side wall 14 of the tank 10 to open and close the lid 40. Because of space restraints imposed by shipping requirements, the counterweight 60 is preferably positioned between the base 82 and the top rail 86 of the frame 80.

The lever end 64 of the counterweight 60 extends away from the lid 40. It is preferable that the lever end 64 extend substantially perpendicular to the pivot axis A, as shown particularly in FIG. 5. The lever end 64 can be angled inward toward the tank 10, provided that the lever end 64 does not contact the tank 10. Alternatively, the lever end 64 of the counterweight 60 can be angled outward away from the tank 10. However, in order to ensure that the containers 1 can be tightly packed during shipping, the lever end 64 of the counterweight 60 is preferably positioned inside of the frame 80, or not far outside of the frame 80.

Although numerous shapes and placements of the counterweights 60 can be used, the overriding objective is to provide a counterweight 60 arrangement which allows a person to open the lid 40 of the container 1 without assistance. When the container is in an upright position with the base 82 resting on a substantially flat surface, the lid 40 should remain opened or closed under the normal force of gravity, i.e. the lid 40 and counterweights 60 are in rotational equilibrium. The lid 40 should not open or close until an additional force F of a desired magnitude has been applied to the counterweights 60, thereby disturbing the rotational equilibrium. The desired amount of additional force F can preferably be provided by a person of ordinary weight 160.

The amount of additional force F required to open or close the lid 40 depends primarily on the length and weight of the counterweights 60. In turn, the acceptable length-to-weight ratio of the counterweights 60 is dependent on the weight of the lid 40. The counterweights 60 must be of a sufficient length and weight in relation to the weight of the lid 40 such that when the lid 40 is in a closed position, the application of a force F having a downward component to the lever end 64 causes the counterweights 60 and the lid 40 to rotate about the pivot axis A, thereby opening the lid 40. The counterweight 60 must also be of a sufficient length and weight in relation to the weight of the lid 40 such that the lid 40 remains open when the force F is removed after the lid 40 has been rotated to the open position. Likewise, the counterweights 60 must be of a sufficient length and weight in relation to the weight of the lid 40 such that when the lid 40 is in the open position, the application of a force F having a downward component to the lever end 64 causes the counterweights 60 and the lid 40 to rotate about the pivot axis A in an opposite direction, thereby closing the lid 40. The counterweights 60 must further be of a sufficient length and weight in relation to the weight of the lid 40 such that the lid 40 remains closed when the force F is removed after the lid 40 has been rotated to the closed position.

The counterweights 60 can readily be configured such that the force F for opening and closing the lid can be provided by applying force directly to the lid. As mentioned above, the front portion 42 of the lid 40 can be provided with handles 49 for this purpose.

The size of the tank 10 and the size of the frame 80 also impose limitations on the length and width of the counterweights 60. The frame 80 will generally be as small as possible relative to the size of the tank 10, so that more containers 1 will fit in a given space. Because bulk containers 1 are designed to be stored next to one another and to be stacked, the counterweight 60 preferably does not extend beyond, i.e outside, the base 82 or top rail 86 of the frame 80. Additionally, because only a relatively small clearance is available between the wall 14 of the tank 10 and the outside edge of the frame 80, the counterweight 60 will preferably be relatively narrow in width.

The counterweight 60 will preferably be only as heavy as needed to allow a person of ordinary weight 160 to easily open and close the lid 40. In order to make the counterweight 60 as light as possible, it will generally be desirable to make the elongated lever end 64 of the counterweight 60 as long as possible within the confines imposed by the frame 80. The counterweight 60 can also be made lighter by placing the center of gravity 70 of the counterweight 60 toward the lever end 64 of the counterweights 60.

The counterweights 60 can be constructed such that they are removable from the fulcrum 50. The removable counterweights 60 can be attached to the fulcrum 50 as needed to open or close the lid 40.

The bulk container of the invention 1 can be provided with a number of standard bulk container accessories, such as the following.

Bulk containers, such as the invention 1, are designed to be inverted in order to dump the contents of the tank. When the container 1 is inverted for dumping, it is preferable to have a means for securing the lid in an open position 180. As shown in the drawings, the securing means 180 can comprise a support bar 182 having pin holes 184 which align with pin holes 184 on the lid 40. When the pin holes 184 are aligned, they can be secured by a securing pin 186, such that lid 40 remains open when the container 1 is inverted. The securing means 180 also provides a safety feature by ensuring that the lid does not fall shut while a person is inspecting or cleaning the tank 10, such as might occur if the container 1 is accidentally struck by a piece of heavy machinery. The support bar 182 provides a back stop for the lid 40 when the lid 40 is in the open position. The support bar 182 also provides additional stability to the frame 80.

The frame 80 can be provided with pad eyes 130 for use in lifting the container 1 with a crane. Four pad eyes 130 will typically be evenly spaced near the top of the vertical support members 84. Another pad eye 130 can be placed on the rear side 2 of base 82 for use in inverting the bulk container 1 to dump out the contents of the container 1.

The frame 80 is preferably provided with forklift slots 125 on the bottom of the frame 80. The forklift slots 125 allow the containers 1 to be stacked one on top of another for storage or shipping. The frame 80 preferably has forklift slots 125 on the front 2 and back 4 of the frame, so that the frame can be lifted from either the front or the back.

The frame can also be provided with one or more ladders 120.

In operation, the counterweight is generally used in either of two ways.

In a first method, a downward force F can be applied to the lever end 64 to open or close the lid 40. In a preferred embodiment, the force F can be supplied by a person of ordinary weight 160. In other configurations, the force F can be supplied by two people acting simultaneously. This method provides a particular safety advantage over the prior art, since the operator's fingers, hands, and arms are not placed near the opening 30, where they could be injured by a falling lid.

In a second method, an upward force can be applied to the front portion 42 of the lid 40 to open the lid 40, and a downward force can be applied to the front portion 42 of the lid 40 to close the lid 40. Although not as fail-safe as the first method, this method does offer safety advantages over the prior art. Because of the counterweight 60 arrangement, the lid 40 of the invention 1 does not shut as rapidly as the lids of prior art bulk containers, and consequently is less likely to fall on the operator. Additionally, in those rare instances in which a person accidentally becomes trapped in a closed container 1, such as during cleaning of the tank, the person will be able to open the lid 40 by applying force to the underside of the front portion 42 of the lid. Under the prior art, the person trapped in the tank would have been unable to open the lid without assistance.

Although the present invention has been described in terms of specific embodiments, it is anticipated that alterations and modifications thereof will no doubt become apparent to those skilled in the art. It is therefore intended that the following claims be interpreted as covering all such alterations and modifications that fall within the true spirit and scope of the invention.

I claim:

1. A portable bulk storage container having a heavy but easy opening lid comprising:

a frame, said frame having a base, a plurality of support members extending upward from said base, and a top rail positioned on said support members, said top rail sized and configured so as to be capable of supporting another portable bulk storage container;

a tank positioned inside said frame, a bottom of said tank rigidly secured to said base of said frame;

a top of said tank having an opening therethrough, said opening positioned substantially on a front portion of said top;

a lid configured to seal said opening, said lid pivotally connected to said top of said tank adjacent a rear edge of said opening, said lid positioned to close and seal said opening when said lid is pivoted to a closed position, said pivotal connection defining a pivot axis;

a connecting member extending from a rear portion of a side of said lid, said connecting member extending beyond a side wall of said tank;

a counterweight having a connecting member end and an elongated lever end;

said counterweight attached to said connecting member adjacent said connecting member end of said counterweight, said lever end of said counterweight extending away from said lid substantially perpendicular to said pivot axis, said counterweight positioned beyond said side wall of said tank such that said counterweight can be rotated along said side wall of said tank; and said counterweight being of a sufficient length and weight in relation to said weight of said lid such that when said container is positioned upright on said base, said lid remains in either said closed or an open position under the normal force of gravity, and such that the application of an additional force having a downward component to said lever end of said counterweight causes said lid to pivot between said closed and said open positions.

2. The container of claim 1, wherein said tank is substantially gas and liquid tight when said lid is secured in said closed position.

3. The container of claim 1, wherein said side wall of said tank is substantially cylindrical.

4. The container of claim 1, wherein said counterweight is configured to have a center of gravity disposed toward said lever end.

5. The container of claim 1, further comprising a handle on an outer side of said counterweight proximate said lever end for applying said force to said counterweight.

6. The container of claim 1, wherein said counterweight is positioned between said base and said top rail of said frame, and said support members are configured to permit said counterweight to rotate between said open and said closed lid positions.

7. The container of claim 1, wherein said connecting member extends substantially parallel to said pivot axis.

8. The container of claim 1, further comprising a lip on said top of said lid, said lip positioned about said opening, and said lid configured to seal said lip when said lid is in said closed position.

9. The container of claim 1, wherein said force for opening and closing said lid can be provided by a person.

10. The container of claim 1, wherein said force for opening and closing said lid can be provided by applying force directly to said lid.

11. The container of claim 1, wherein said frame is configured to allow a person standing outside of said frame to access said counterweight and to rotate said counterweight to rotate said lid between said open and said closed positions.

12. The container of claim 1, further comprising means on said tank for securing said lid in said closed position.

13. The container of claim 1, further comprising a support bar on said frame for supporting said lid in an open position and means on said support bar for securing said lid in said open position.

14. A portable bulk storage container having a heavy but easy opening lid comprising:

a frame, said frame having a base, a plurality of support members extending upward from said base, and a top rail positioned on said support members, said top rail sized and configured so as to be capable of supporting another portable bulk storage container;

a tank positioned inside said frame, a bottom of said tank rigidly secured to said base of said frame;

a top of said tank having an opening therethrough, said opening positioned substantially on a front portion of said top;

a lid configured to seal said opening, said lid pivotally connected to said top of said tank adjacent a rear edge of said opening, said lid positioned to close and seal said opening when said lid is pivoted to a closed position, said pivotal connection defining a pivot axis;

a first connecting member extending from a rear portion of a side of said lid, a second connecting member extending from an opposite side of a rear portion of said lid, each of said first and second connecting member extending beyond a side wall of said tank;

a first and a second counterweight, each of said counterweights having a connecting member end and an elongated lever end;

said first counterweight attached to said first connecting member adjacent said connecting member end of said first counterweight;

said second counterweight attached to said second connecting member adjacent said connecting member end of said second counterweight;

said lever ends of said first and second counterweights extending away from said lid substantially perpendicular to said pivot axis, said first and second counterweights positioned beyond said side wall of said tank such that said counterweights can be rotated along said side wall of said tank; and said first and second counterweights together being of a sufficient length and weight in relation to the weight of said lid such that when said container is positioned upright on said base, said lid remains in either said closed or an open position under the normal force of gravity, and such that the application of an additional force having a downward component to said lever end of one or both of said counterweights causes said lid to pivot between said closed and said open positions.

15. The container of claim 14, wherein said tank is substantially gas and liquid tight when said lid is secured in said closed position.

16. The container of claim 14, wherein said side wall of said tank is substantially cylindrical.

17. The container of claim 14, wherein said counterweight is configured to have a center of gravity disposed toward said lever end.

18. The container of claim 14, further comprising a handle on an outer side of said counterweight proximate said lever end for applying said force to said counterweight.

19. The container of claim 14, wherein said counterweight is positioned between said base and said top rail of said frame, and said support members are configured to permit said counterweight to rotate between said open and said closed lid positions.

20. The container of claim 14, wherein said first and second connecting member extend substantially parallel to said pivot axis.

21. The container of claim 14, further comprising a lip on said top of said lid, said lip positioned about said opening, and said lid configured to seal said lip when said lid is in said closed position.

22. The container of claim 14, wherein said force for opening and closing said lid can be provided by a person.

23. The container of claim 14, wherein said force for opening and closing said lid can be provided by applying force directly to said lid.

24. The container of claim 14, wherein said frame is configured to allow a person standing outside of said frame to access said counterweight and to rotate said counterweight to rotate said lid between said open and said closed positions.

25. The container of claim 14, further comprising means on said tank for securing said lid in said closed position.

26. The container of claim 14, further comprising a support bar on said frame for supporting said lid in an open position and means on said support bar for securing said lid in said open position.

* * * * *